United States Patent [19]

Stenner

[11] Patent Number: 5,015,137

[45] Date of Patent: May 14, 1991

[54] BOOKLET WITH CENTRAL DETACHABLE BUSINESS REPLY ENVELOPE AND OPTIONAL RESPONSE DEVICE PRODUCED FROM AN INTEGRAL WEB AND METHODS OF PRODUCTION

[75] Inventor: John W. Stenner, Orange, Conn.

[73] Assignee: Kurt H. Volk, Inc., Milford, Conn.

[21] Appl. No.: 309,202

[22] PCT Filed: Mar. 28, 1988

[86] PCT No.: PCT/US88/01118

§ 371 Date: Nov. 30, 1988

§ 102(e) Date: Nov. 30, 1988

[87] PCT Pub. No.: WO89/09136

PCT Pub. Date: Oct. 5, 1989

[51] Int. Cl.[5] ..... B41L 43/12

[52] U.S. Cl. ..... 412/1; 229/73; 229/74; 281/5; 281/15.1

[58] Field of Search ..... 229/70, 73, 74; 281/2, 281/5, 15; 282/11.5 R; 412/1; 270/32, 40, 41

[56] References Cited

U.S. PATENT DOCUMENTS

| | | | |
|---|---|---|---|
| 2,118,964 | 5/1938 | Bonnaire | 281/5 |
| 3,718,277 | 2/1973 | Volkert | 281/15.1 X |
| 3,883,069 | 5/1975 | Volkert | 229/73 |
| 3,907,271 | 9/1975 | Lyon | 412/1 X |
| 4,524,903 | 6/1985 | Vath | 229/73 |
| 4,534,581 | 8/1985 | Engh | 281/5 X |
| 4,637,633 | 1/1987 | Instance | 281/5 X |
| 4,651,920 | 3/1987 | Stenner | 229/73 X |
| 4,773,584 | 9/1988 | Instance | 229/74 |

*Primary Examiner*—Paul A. Bell
*Assistant Examiner*—Hwei-Siu Payer
*Attorney, Agent, or Firm*—Thomas E. Spath

[57] ABSTRACT

A computer personalized printed booklet with a detachable business reply envelope and one or more optional response devices (33, 35; 233, 235) positioned within the booklet and made from a continuous pre-printed web (20, 20', 220) is disclosed along with methods for manufacturing the article.

26 Claims, 8 Drawing Sheets

BOOKLET WITH CENTRAL DETACHABLE BUSINESS REPLY ENVELOPE AND OPTIONAL RESPONSE DEVICE PRODUCED FROM AN INTEGRAL WEB AND METHODS OF PRODUCTION

BACKGROUND OF THE INVENTION

1. Field of the Invention

This invention relates to a booklet with an integral detachable business reply envelope at its central fold made from a continuous, pre-printed web and methods for its manufacture which are especially suited for use with computerized operations such as those involving computer personalized web lithographic printed forms. In particular, the invention relates to a booklet containing a plurality of pages with an integral detachable business reply envelope and response device which remains an integral structure throughout all operations up to and including the final folding and finishing steps.

2. Description of the Prior Art

In recent years, computer directed printers have been utilized in connection with the personalization of large volume mailings relating to advertising or solicitation campaigns. In particular, the information in the computer's data input system, which contains the normal addressee mailing information for printing the envelope, has also been used in various forms to personalize the pre-printed advertising materials being transmitted. In its simplest and most common form, this personalization can constitute the inclusion of the addressee's name and a salutation line in what otherwise would be recognized as a form letter. The intended effect of such personalized advertising messages is, of course, to capture and maintain the attention of the addressee for the purpose of having him read all the information transmitted. These personalization techniques have resulted in increased returns to the advertiser, thereby enhancing the value of the article as a selling and solicitation medium.

In addition, the computer directed print-out devices have been used in conjunction with continuous high speed web lithographic printing equipment to produce advertising materials that include not only personalized salutations, but also the repetition of the addressee's name and other related personal information in various locations throughout the advertising material. Until recently, formats for such personalized mass produced mail advertising materials have been limited by economic considerations to letters or simple brochures.

One example of a personalized brochure is disclosed in U.S. Pat. No. 3,907,271 in which a computer personalized step-down booklet is produced from a continuous, pre-printed web that is capable of being assembled and finished in a continuous operation. The pre-printed, personalized web is divided into discrete sheets by perforations along transverse longitudinal lines perpendicular to the backbone of the booklet that correspond to the lines between the head and foot of adjacent sheets. The sheets are then die-cut along their marginal edges parallel to the longitudinal edges of the web and the booklet backbone between the perforated lines, and the resulting marginal strip portions are "burst" or removed from the external edges of the sheets comprising the web. The booklet is then formed by folding the sheets in an appropriate manner along the perforation lines into an overlying and superposed configuration in which the pages constituting the finished booklet are in proper numeric sequence. Thus, the art was advanced sufficiently to allow personalization on several pages in a booklet without the attendant risk of mismatching of the personalized pages during final assembly. However, prior to the development of the subject invention, methods of producing booklets having a plurality of personalized pages in which an integral detachable pre-printed business reply envelope, and optionally, a personalized reply device or form, were not known. Heretofore, such reply devices have been, for example, loosely inserted between the pages of the finished booklet following assembly. If these loosely inserted reply devices are separated from the booklet, the incidence of favorable responses will be reduced.

Accordingly detachable, it is an object of the present invention to provide a booklet having a one or more personalized pages and an integral, easily detachable business reply envelope and response device, and a method for producing such a booklet in a single operation from a single continuous web, thereby avoiding the risk of mismatching of the personalized booklet with a personalized response device and reply envelope.

Another object of the present invention is to provide a method for producing a booklet having an integral business reply envelope and response device which obviates the necessity of manually handling sheets which comprise the pages of the booklets during the final stages of booklet assembly.

A further object of the present invention is to provide a method of producing a booklet from a web having an integral business reply envelope and response device in which the booklet, business reply envelope, and response device are finished in a single operation.

Still yet another object of the present invention is to provide a method of assembling a booklet having a plurality of personalized pages and a business reply envelope, a response device optionally being provided, in which the method avoids any possibility of mismatching of personalized pages.

A particular object of the present invention is to provide a method of producing a personalized booklet, business reply envelope, and response device that is readily adapted for use with computer directed printers in conjunction with continuous high speed web lithographic printing equipment.

SUMMARY OF THE INVENTION

The invention provides a booklet and business reply envelope which may be prepared from a continuous web of pre-printed material and personalized on at least one of the pages of the finished booklet. In a preferred aspect of the invention, the booklet also includes a detachable response device. The section of the web comprising the pre-printed, personalized booklet, business reply envelope and response device remains an integral unit until after bonding, thereby precluding any possibility of the occurrence of a mismatching of personalized pages or other elements in any one of the booklets.

The pre-printed web is divided into sheets, preferably by perforations, along spaced apart parallel transverse lines perpendicular to the longitudinal line which forms the backbone of the booklet, the transverse lines corresponding to the head and foot portions of adjacent sheets. Each sheet comprises four pages, front and back, joined along the longitudinal line of the web. The transverse lines can be equally spaced apart to provide sheets having pages of substantially the same size, or they can be appropriately spaced to provide a booklet of differently sized or progressively sized pages. The sheets are then die cut along their marginal edges parallel to and adjacent the longitudinal edges of the web and between the perforated lines, and the resulting marginal strips are "burst" or removed from the lateral edges of the sheets comprising the web. The sheets are then folded in an appropriate manner along the perforated lines into an overlying and superposed configuration in which the pre-printed pages comprising the finished booklet are in proper sequence. The perforated lines serve the dual purpose of facilitating the separation of the web sections comprising the sheets of each booklet and the subsequent folding of the sheets.

The business reply envelope is formed from the two internal opposingly facing pages. An adhesive or glue is deposited along the head and foot of the opposed pages prior to folding of the booklet along its backbone. As the booklet is folded along its backbone, the facing sheet portions are bound together by the adhesive, thereby forming the business reply envelope. The head and foot of the booklet, where adjacent sheets remain joined along the perforated lines, are then slit or trimmed off to produce the finished booklet.

The method of the present invention avoids the problems attendant the production of booklets containing a business reply envelope and response forms which are separately assembled, by maintaining the sheets as an integral part of a continuous web until the sheets have been bound together in an overlying configuration and in a manner in which there is no opportunity for an omission or misplacement of any other pages or sheets comprising the booklet, business reply envelope, and response device. Furthermore, the disclosed method is particularly suited for use with a computer directed printing system which is capable of personalizing a number of pages of the web prior to page separation, since the method avoids completely the possibility of mismatching of personalized sheets in any one of the booklets. In addition to the above-noted advantages, the present invention provides a method of producing a personalized booklet having a business reply envelope and optional response device that is adapted to high speed web lithographic printing techniques in which multiple pages can be finished in one operation, thereby resulting in more efficient utilization of equipment and a reduction in overhead associated with manual handling of the separate sheets.

BRIEF DESCRIPTION OF THE DRAWINGS

In the drawings accompanying and forming a part of the specification.

DETAILED DESCRIPTION OF THE PREFERRED EMBODIMENTS

Figure 1:
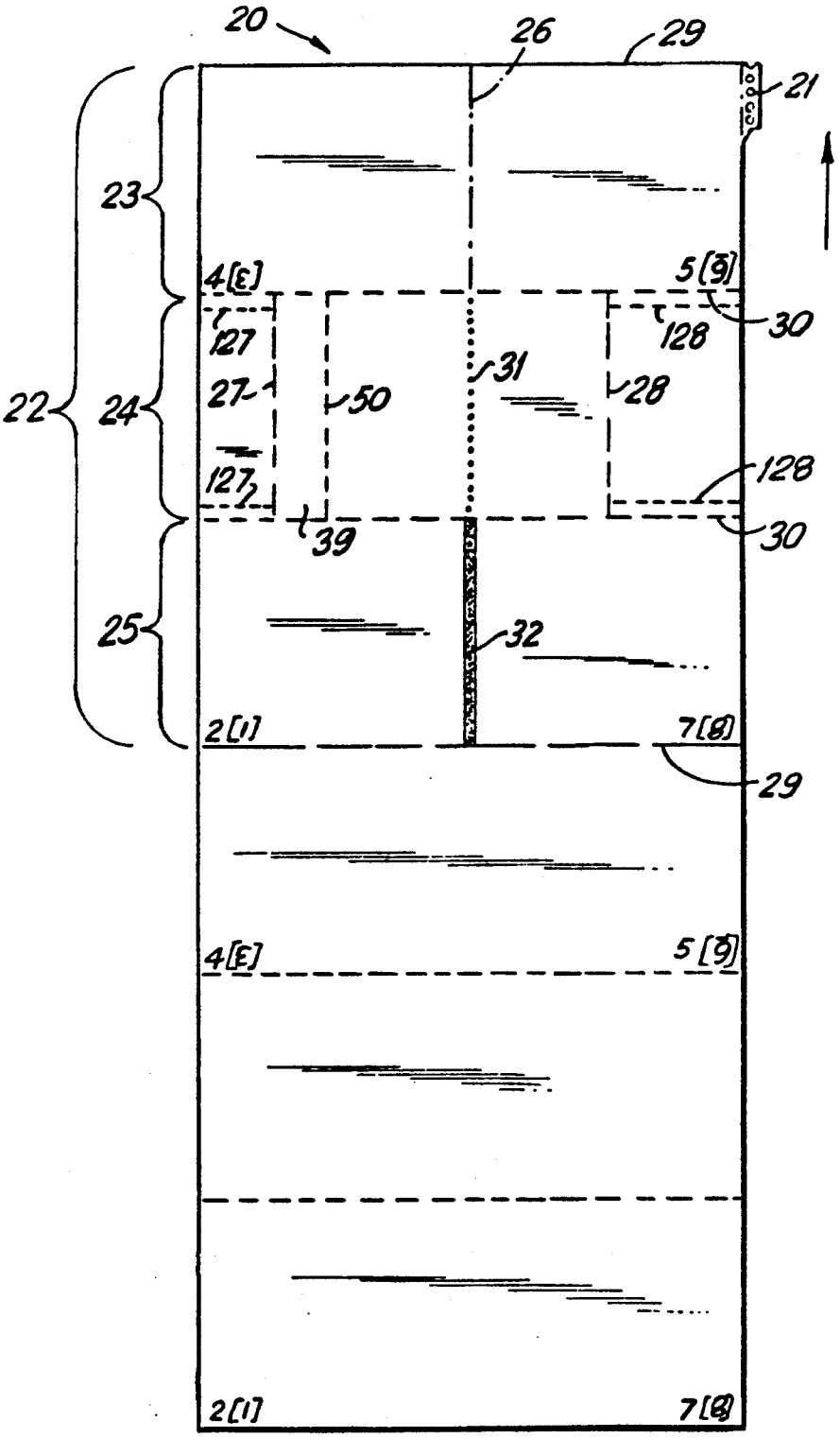
FIG. 1 is a plan view of a section of continuous web containing an eight page booklet with integral business reply envelope and response device of the present invention.

Referring to the drawings in detail, wherein like reference characters designate corresponding parts throughout the several figures, and particularly to FIG. 1, there is shown a web of continuous form paper 20 with marginal line holes 21. The web form contains the repeated impression of an eight page booklet 22, envelope and optional reply device, each complete booklet impression 22 being separated by transverse booklet delineating lines 29. Construction of booklets having a different number of pages is discussed below in connection with FIGS. 9-13. A booklet with integral business reply envelope and response device is formed from each repeating web impression 22. The eight page booklet impression 22 is further divided into sheets 23, 24 and 25 by transverse spaced apart page delineating lines 30. Lines 29 and 30 are preferably formed of perforations, but could be scored or otherwise treated to facilitate folding and separation. The transverse page delineating lines 30 are generally equally spaced, as shown in the drawing, to provide booklet pages of the same size, or the lines 30 can be appropriately spaced to provide a booklet having sheets of booklet pages of different sizes or of progressively increasing or decreasing size. Sheets 23 and 25 comprise pre-printed booklet pages corresponding to paired page numbers 4 and 5, and 2 and 7, as shown. On the reverse side of the web, booklet pages 3 and 6, and 1 and 8 are pre-printed and shown in the drawing figures as the numbers contained in brackets. Sheet 24, which comprises the as yet unformed reply envelope and response device, is ordinarily not numbered. However, appropriate page reference numbers can be provided, if desired. Preferably, the booklet delineating perforation lines 29 are made substantially weaker than the page delineating perforation lines 30 in order that a longitudinal force applied to separate or "burst" the booklet sections 22 from the web will not cause the paper web to tear or the sheets of each booklet section to separate along page delineating lines 30. Slit-type perforations are well suited to provide a weakened parting line at 29.

Longitudinal perforations, which can be slit-type perforations, are made in the web as shown at 27 and 28. Transverse perforations 127 and 128, which extend outwardly from perforation lines 27 and 28, respectively, can optionally be provided. The function of perforation lines 27, 28, 127 and 128 is described below in conjunction with the formation of the business reply envelope and response device. While the longitudinal perforations 27 and 28 and transverse perforations 127 and 128 can be made in the preferred embodiment of the eight-page booklet in the same sequence of operations as the booklet separating lines 29 and the transverse perforation lines 30, it should be noted that they can be made at any stage prior to the folding operation.

As will be apparent to one skilled in the art, the layout of the printed matter constituting the pages of the booklet will depend on the manner in which the form 20 is folded and the number and order of pages for which computer directed printed personalization is desired. In addition to the overlapping type of fold shown in the drawing figures, an accordion, or zig-zag, fold can be used to align the sheets in a superposed configuration. It is also possible to produce booklets having a greater number of pages by increasing the length of the web and the number of transverse lines 30 to form additional sheets on the pre-printed web.

It will be appreciated that the number of pages which are personalized is determined by the relation of the direction of the printed matter on the sheets with respect to the direction in which the computer directed printer is aligned. For example, the format shown in FIG. 1 would permit personalization on one or more lines of paired pages 4 and 5, and 2 and 7, as the web 20 is carried in the direction of the arrow past a conventional computer directed printer head (not shown). However, if a printer is used that is capable of printing in a first direction and also in a direction rotated 180°, (e.g., a laser printer), then the pages designated by the inverted page numbers can also be personalized. Furthermore, two such printers can be oriented so that both sides of all pages of the booklet, including the business reply envelope and response device, can be personalized.

Figure 2:
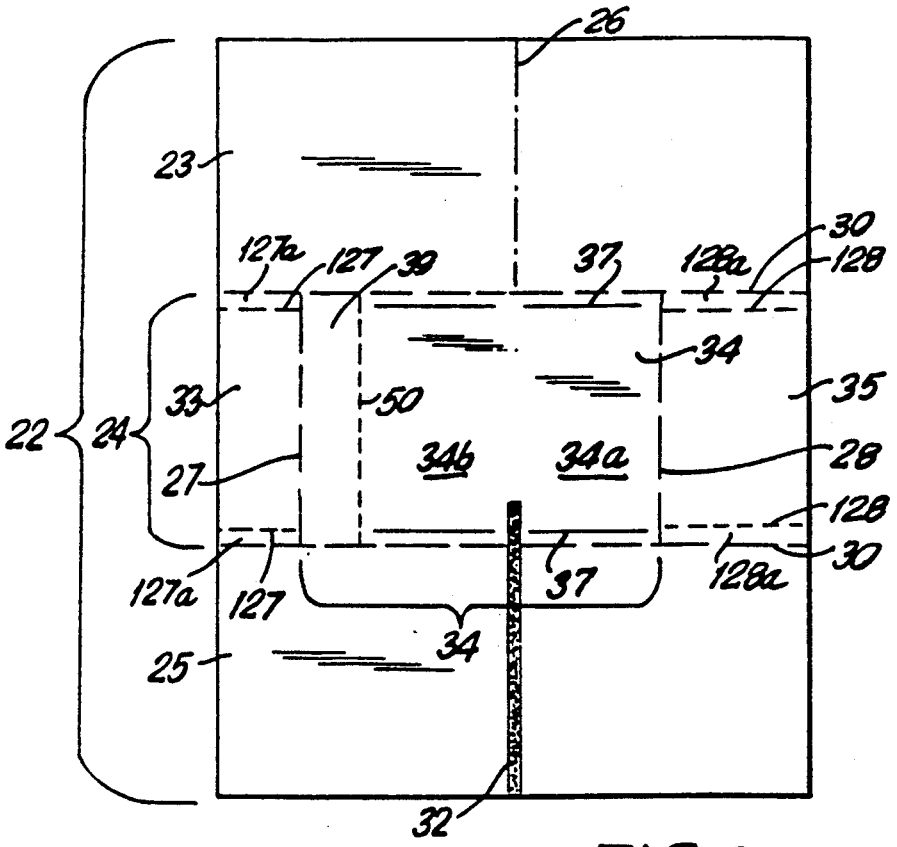
FIG. 2 is a plan view of the web section depicted in FIG. 1 separated from the continuous web after die cutting and removal of the marginal portions.

With reference to FIG. 2, there is shown a web section 22 comprising an entire eight page booklet impression that has been separated along perforations 29 from the remainder of the web 20. Web section 22, as shown, has been die cut along the marginal edges and the excess material has been removed.

Longitudinal perforations 27 and 28 divide sheet 24 into three sections 33, 34 and 35. Sheet section 34 is divided into rear envelope panel **34*a*, front envelope panel 34*b* and flap 39. As is described in greater detail below in connection with FIG. 4, envelope panels 34*a* and 34*b*, when folded along longitudinal line 26, will form a business reply envelope. Section 35 forms an optional response device detachably connected to the business reply envelope along perforation line 28. Sheet section 33 can be used as an additional detachably connected response device, or for any other desired purpose, such as advertisement or to convey a further message or instructions. If only the business reply envelope is desired, sections 33 and 35 can be removed from the sheet during processing at any convenient time, and preferably when the marginal sections are removed from the form. It will be appreciated that the relative dimensions of sheet sections 33, 34 and 35 can vary from those depicted, and that perforation lines 27 and 28 need not be symmetrically formed with respect to longitudinal line 26. The optional transverse perforation lines 127 and 128 can be provided to facilitate dimensioning of one or both of the respective sheet sections 33 and 35 so that they can be inserted into the completed business reply envelope without folding. This dimensioning is accomplished by removing the transverse marginal portions 127*a* and 128*a* lying between the transverse page delineating perforation lines 30 and the perforation lines 127 and 128, respectively. The transverse marginal portions 127*a* and 128*a* can be burst following die cutting along the marginal lines of the sheets comprising the booklet, as described above, or they can be left attached to sheet sections 33 and 35, respectively, for removal by the recipient. Furthermore, if either section 33 or 35 of sheet 24 is not required, it can also be removed during the die cutting step or any other step prior to folding. It is important that the die cut portions of perforated lines 27 and 28 intersect the die cut portions of transverse perforated lines 30 to ensure that the sheet sections 33 and 35** can be freely and clearly separated from the business reply envelope without tearing the page material or leaving an unfinished edge or corner on the response form or envelope.

Prior to folding, suitable adhesives, are applied along lines 31 and 32. A releasable adhesive is applied along dotted line 31, as shown in FIG. 1. The adhesive along line 31 has sufficient tack to retain sheet 24 comprising the business reply envelope and response device in the finished booklet during shipment and normal handling by the individual reader. However, the adhesive is of a type known in the art which provides for easy separation of the reply envelope and response device from the finished booklet with the application of a small amount of force. The glue deposited along line 32 is of sufficient strength to essentially permanently bind the sheets comprising the remainder of the booklet. As shown in FIG. 2, the adhesive applied along line 32 can be extended partially into sheet 24 to provide for detachable retention of the business reply envelope along the lower corner of the envelope. Application of adhesive line 32 in this manner dispenses with the need for applying the dots of adhesive along line 31.

Figure 3:
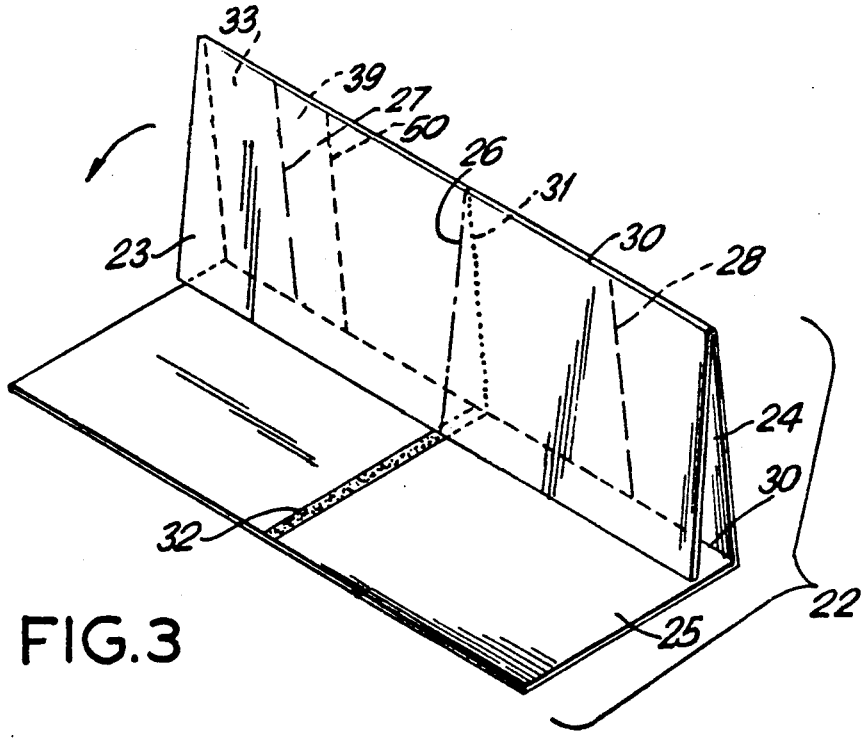
FIG. 3 is a perspective view of the die cut section of the web depicted in FIG. 2 following partial folding along transverse page-delineating perforations.

FIG. 3 shows section 22 folded along page delineating perforations 30 into what will be the superposed configuration. As previously mentioned, it is preferred that the adhesive be applied along lines 31 and 32 immediately prior to folding so as to reduce the risk of adhesive buildup, thereby decreasing the risk of machine failure. By folding the sheets as shown in FIG. 3, the releasable adhesive along line 31 on sheet 24 serves to bind it to sheet 23. The adhesive along line 32 comes in contact with sheet 23 along longitudinal line 26, thereby binding those two sheets along what will become the backbone of the booklet. Longitudinal line 26 can extend along the center line of the web section 22 as shown, or can extend offset from the longitudinal center line to provide a booklet having pages of different widths. Sheets 23 and 25 are permanently bound by the adhesive along line 32, whereas sheet 24, comprising the as-yet unformed business reply envelope and response device, is releasable secured to sheet 23 by the releasable adhesive along line 31.

Figure 4:
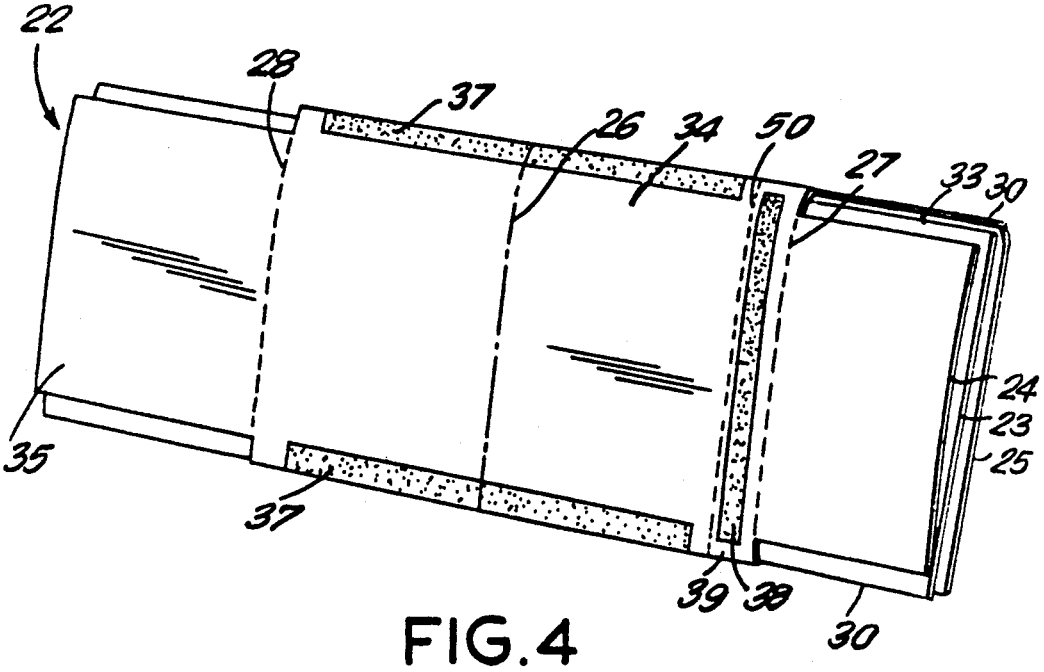
FIG. 4 is a perspective view of the web section of FIGS. 1-3 illustrating details of the two central pages from which the business reply envelope and response device are constructed.
Figure 5:
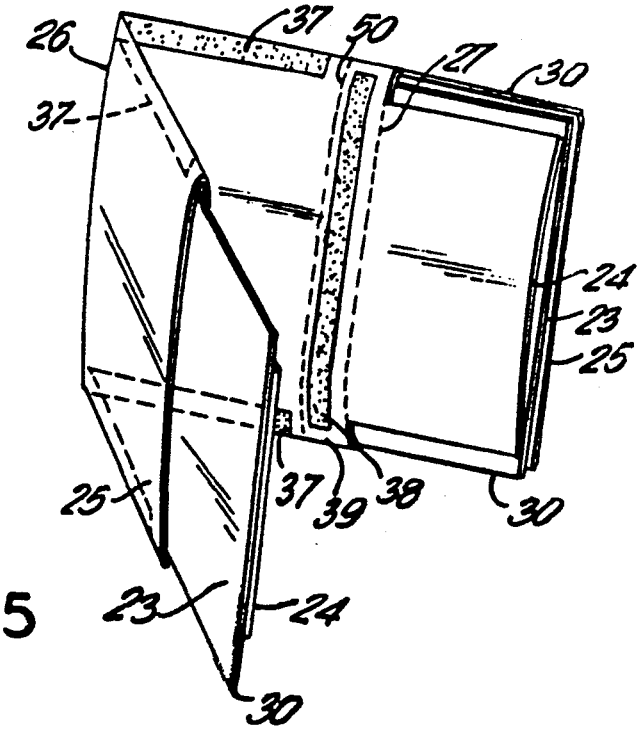
FIG. 5 is a perspective view of the web illustrated in FIG. 4 partially folded during formation of the booklet.
Figure 7:
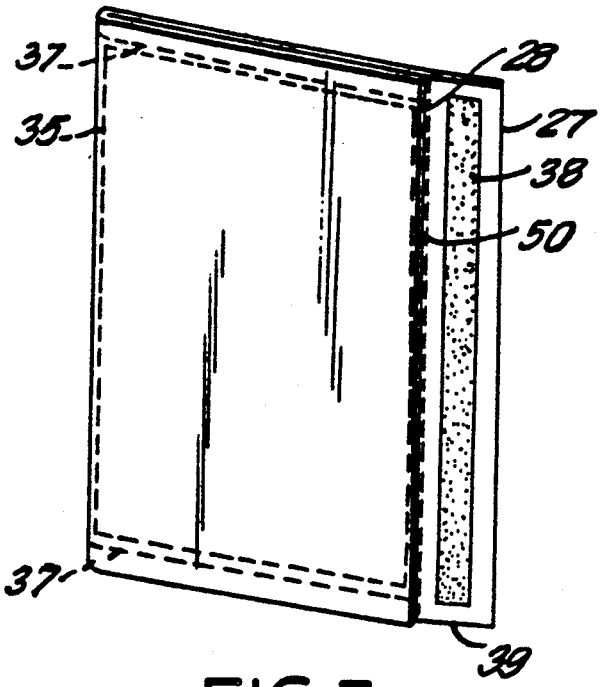
FIG. 7 is a perspective view of the business reply envelope separated from the booklet and having a response device inserted therein for mailing.

With reference to FIG. 4, web 22 is shown in a folded configuration with sheets 23, 24 and 25 being superposed. In addition, there is depicted in greater detail the business reply envelope and response device, which is comprised of the delineated sections 33, 34 and 35 of sheet 24. Transverse marginal portions 127*a* and 128*a* have been removed. A suitable adhesive, such as the pressure-sensitive adhesive discussed above that is applied along line 32, is deposited along spaced apart, parallel lines 37 adjacent the head and foot of sheet section 34. A conventional remoistenable glue is applied along an area 38 near the outer edge of envelope flap 39 adjacent perforation line 27 for use by the ultimate recipient in sealing the business reply envelope. It will also be seen from FIG. 4 that stitching, such as wire staples, could be employed in place of adhesive to join the booklet sheets and envelope sheet along longitudinal fold line 26. Envelope flap 39 is formed by the portion of front envelope panel 34*b* that extends beyond the edge of envelope section 34*a* when the assembly of FIG. 4 is folded along longitudinal center line 26, as shown in FIG. 5. Perforation line 50 is provided on the opposite side of area 38 from perforation line 27 to facilitate folding of the envelope flap 39. Stated in another way, perforation line 27 is further from longitudinal center line 26 than is perforation line 28 by an amount sufficient to form the envelope flap 39. Thus, when folded along longitudinal center line 26 and glued along lines 37, the central portion 34 of sheet 24 will form a business reply envelope that conforms to existing postal regulations, as shown in FIG. 7.

After the booklet 22 has been folded along backbone 26, as shown in FIG. 5, the top and bottom, i.e, the head and foot, of the booklet can be trimmed by scissor wheel cutting or guillotine cutting as known in the art to separate the individual sheets from one another, thereby forming a booklet having a plurality of pages. Alternatively, the sheets can be separated along the perforation lines 30, 30.

Figure 6A:
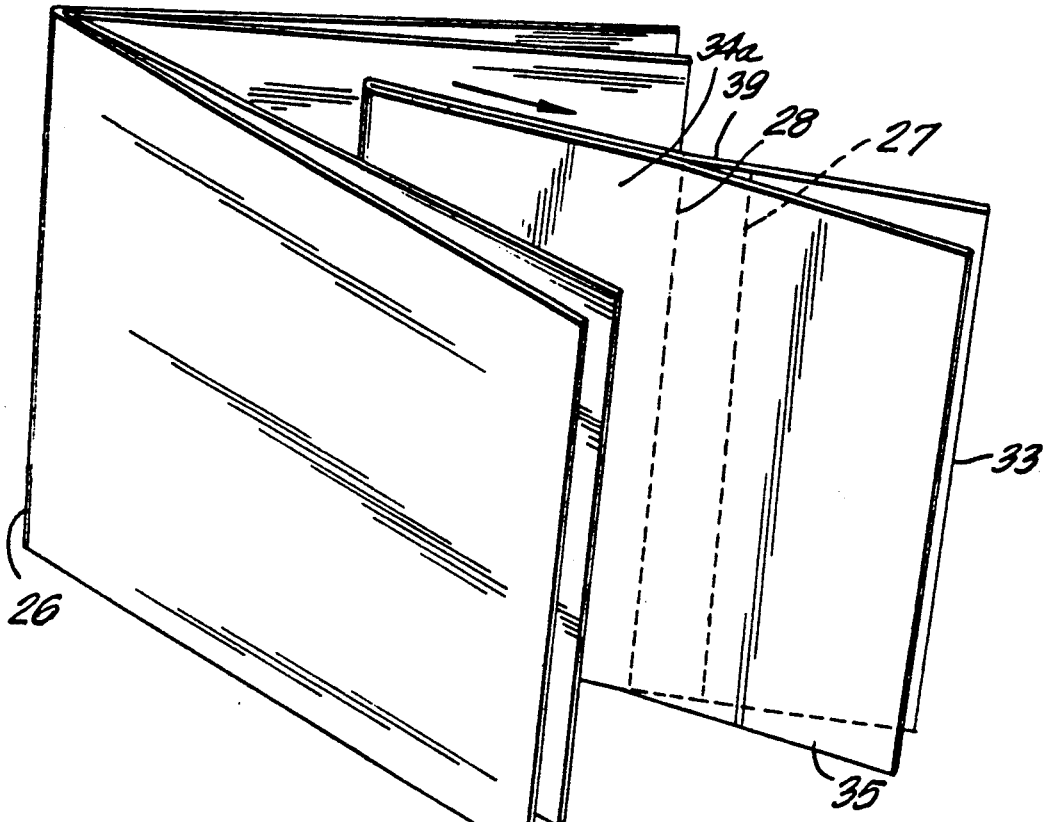
FIG. 6A is a perspective view of a completed booklet of evenly sized pages with the business reply envelope and response device detached.
Figure 6B:
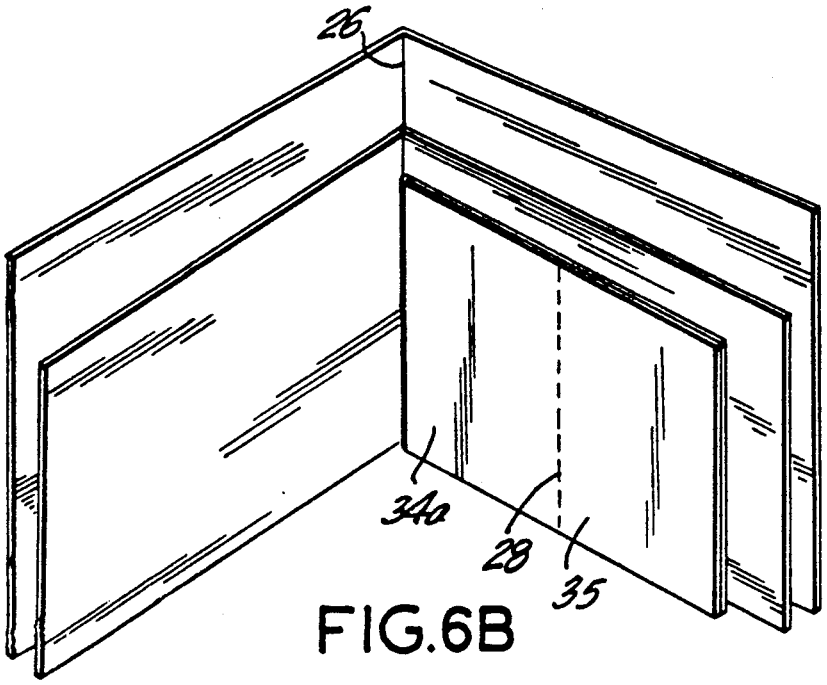
FIG. 6B is a perspective view of a completed booklet having different sized pages and a detachable business reply envelope.

FIG. 6A shows a completed booklet of evenly sized pages with the business reply envelope and response device detached from the booklet backbone 26. The business reply envelope is shown in greater detail in FIG. 7, and is shown as having the response device 35 separated from, and inserted into, the envelope. Depending on the spacing of the perforation lines 30, a booklet having pages of varying sizes can be formed, as illustrated in FIG. 6B, by die-cutting, trimming and bursting in accordance with the methods previously described.

Figure 8:
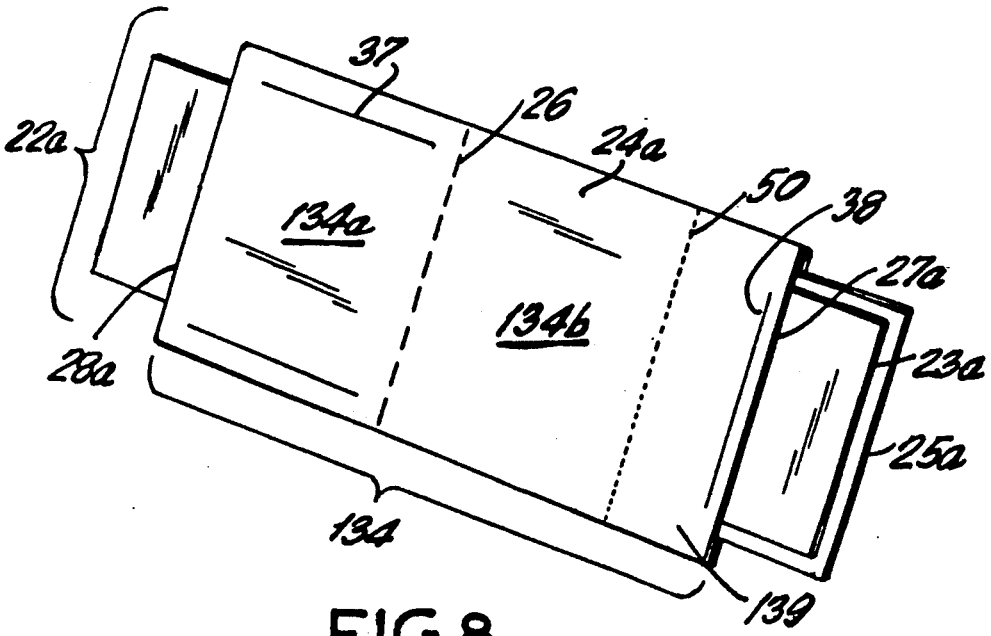
FIG. 8 is a perspective view of an alternative embodiment illustrating details of the two central pages from which the business reply envelope is formed.

In another embodiment of the invention illustrated in FIG. 8, a booklet having a plurality of pages and a reply envelope, (without a detachable reply device as described above), is formed from a booklet section 22*a* that is divided into a plurality of sheets 23*a*, 24*a* and 25*a* that can be form-printed and personalized in the manner described above. Sheet 24*a* is divided by perforations 27*a* and 28*a* into three separate sheet sections, of which only envelope sheet section 134 is depicted. Envelope sheet section 134 is divided by longitudinal line 26 into envelope panels 134*a* and 134*b* which, when folded together in the manner described above, form a business reply envelope. Booklet section 22*a* of this alternative embodiment is processed in an identical manner as the booklet section 22 of the preferred embodiment of FIGS. 1–7, with the exception that sheet sections corresponding to sections 33 and 35 of the embodiment of FIGS. 1–7 are removed, (preferably during bursting), prior to the depicted folding step. Instead of providing for entry of desired reply information on a detachable response device, as set forth in the first embodiment, the embodiment of FIG. 8 provides for entry of the reply information directly onto the business reply envelope. This information can be recorded on, for example, the envelope flap 139, which is preferably oversized (as shown) to provide ample space for entry of the desired data. It will be appreciated that the relative size of each of the sheet sections forming the envelope sheet 24*a* is a function of the placement of longitudinal perforation lines 27*a* and 28*a*. Therefore, an oversized envelope flap, such as flap 139, can be obtained by forming perforation line 27*a* a relatively greater distance from center line 26 than is perforation line 28*a*. In all other respects, the booklet section 22*a* of FIG. 8 is identical to that depicted in FIGS. 1–7 in that it can be form printed, personalized and finished to provide the desired booklet having separate, personalized pages and a reply envelope.

Figure 9:
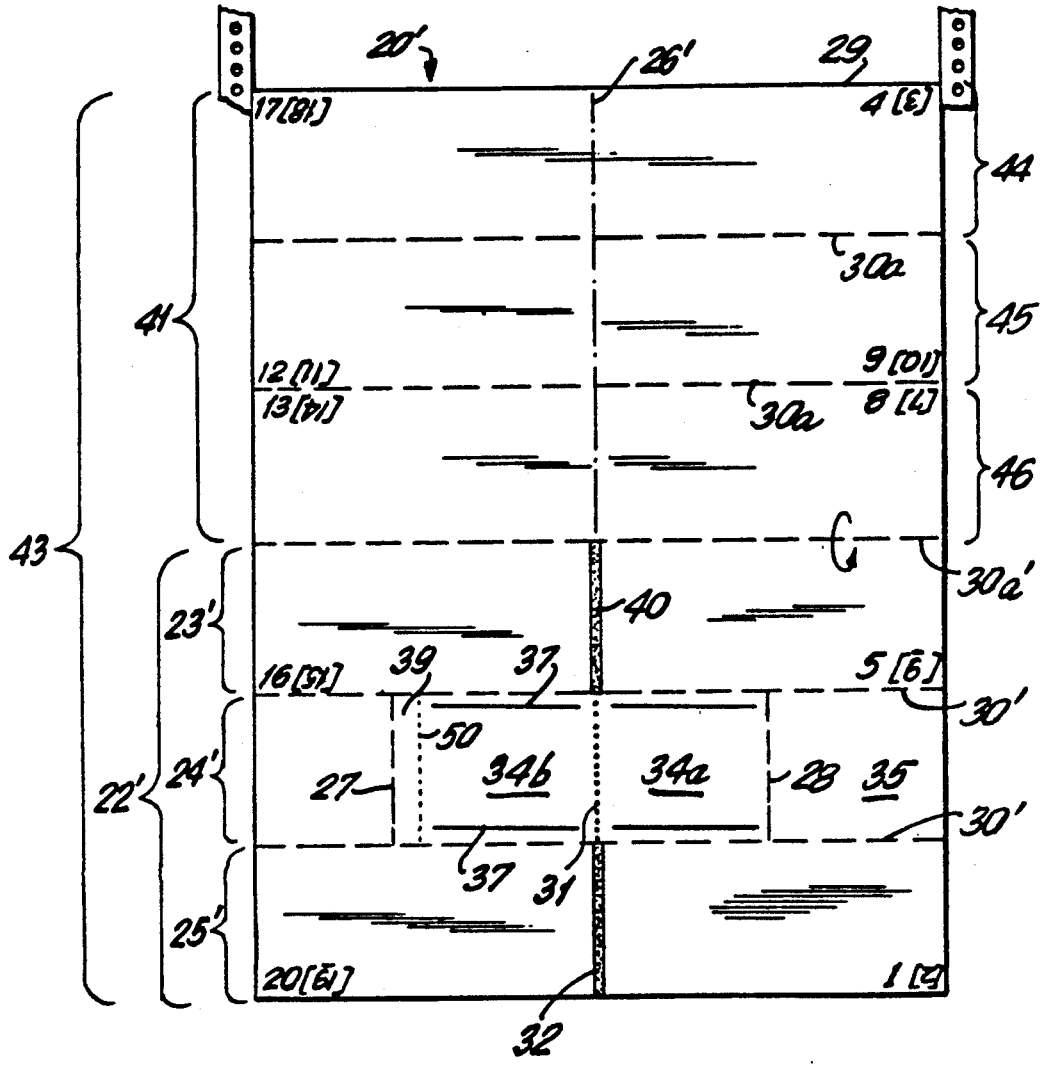
FIG. 9 is a plan view of a section of web for use in constructing a 20-page booklet.
Figure 10:
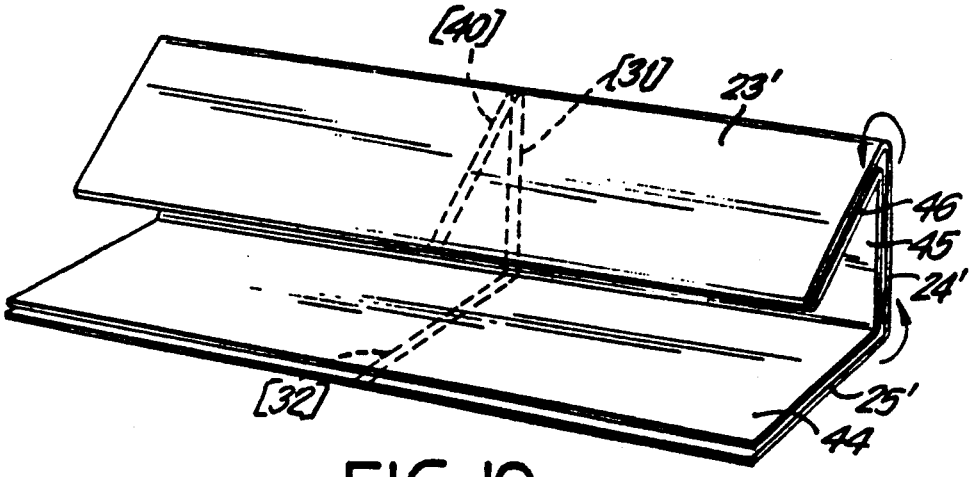
FIG. 10 is a perspective view of the web of FIG. 9 folded to form a partially formed booklet of double-page thickness.
Figure 11:
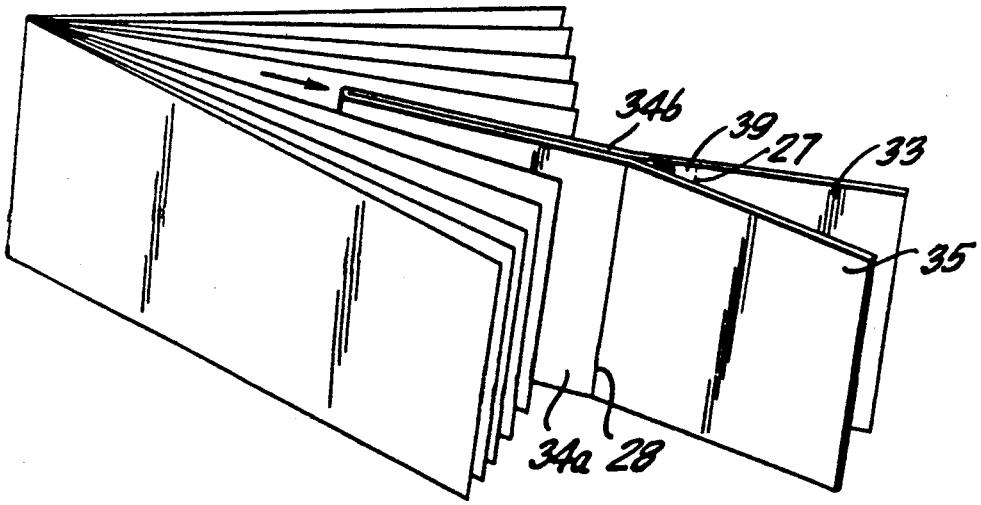
FIG. 11 is a perspective view of a finished 20-page booklet containing an integral business reply envelope and response device, with the business reply envelope and response device detached from the booklet.

In FIGS. 9–11 there is shown a further embodiment of the present invention comprising a 20-page booklet with integral business reply envelope and response device. A preferred form of the 20-page booklet is constructed from two 3-sheet sections formed from web 20', as shown in FIG. 9.

In accordance with one of the objects of the invention, namely that the entire booklet, business reply envelope and response device be constructed from a single sheet or section of web that remains a single unit throughout the various steps of construction, 20 page booklet impression 43 comprises 8-page booklet section 22' adjacent an additional 12-page section 41. The 20-page impression 43 is processed in a manner similar to that of the 8-page booklet impression described in detail above. The additional 12-page section 41 is similar to the 8-page booklet impression 22' in that it is comprised of sheets 44, 45 and 46 delineated by two transverse perforation lines 30*a*. The two sheet sections 41 and 22' are separated by section delineating perforation line 30*a'*, which divides the booklet impression into two generally equally sized halves.

Sheet 45 of the additional 12-page section 41 differs from the corresponding sheet 24' of section 22' in that there are no longitudinally-oriented perforation lines adjacent perforated longitudinal fold line 26'. Since the preferred embodiment of the 20-page booklet provides for only one business reply envelope and response device per booklet, only one set of longitudinally oriented envelope sheet perforation lines 27, 28 is require for each booklet impression 43. It should also be noted that the printing layout for sheets 23', 24' and 25' in the 20-page embodiment differs from that of corresponding sheets 23, 24 and 25 in the 8-page embodiment due to differences in the folding sequence of these pages, as illustrated in FIGS. 9 and 10. Additionally, a third area 40 is provided along sheet 23' for application of an adhesive of the type used along line 32 discussed above. The adhesive provided along line 40 serves to join sheets 23' and 46 after the 20-page section 43 is folded along section separation line 30*a'* in the direction of the arrows in FIGS. 9 and 10, such that sheet 41 is superposed onto sheet 22'. Reference numerals for adhesive lines 31, 32 and 40 are bracketed, and the respective lines are denoted by dotted lines in FIG. 10 since they would otherwise be hidden from view. After application of the adhesive, the 20-page web section 43 is processed in the same manner as set forth above in connection with the 8-page embodiment previously described.

FIG. 11 is a perspective view of the 20-page booklet having had the head and foot areas trimmed or separated as previously described. The business reply envelope and response device is shown partially removed from the booklet.

Figure 12:
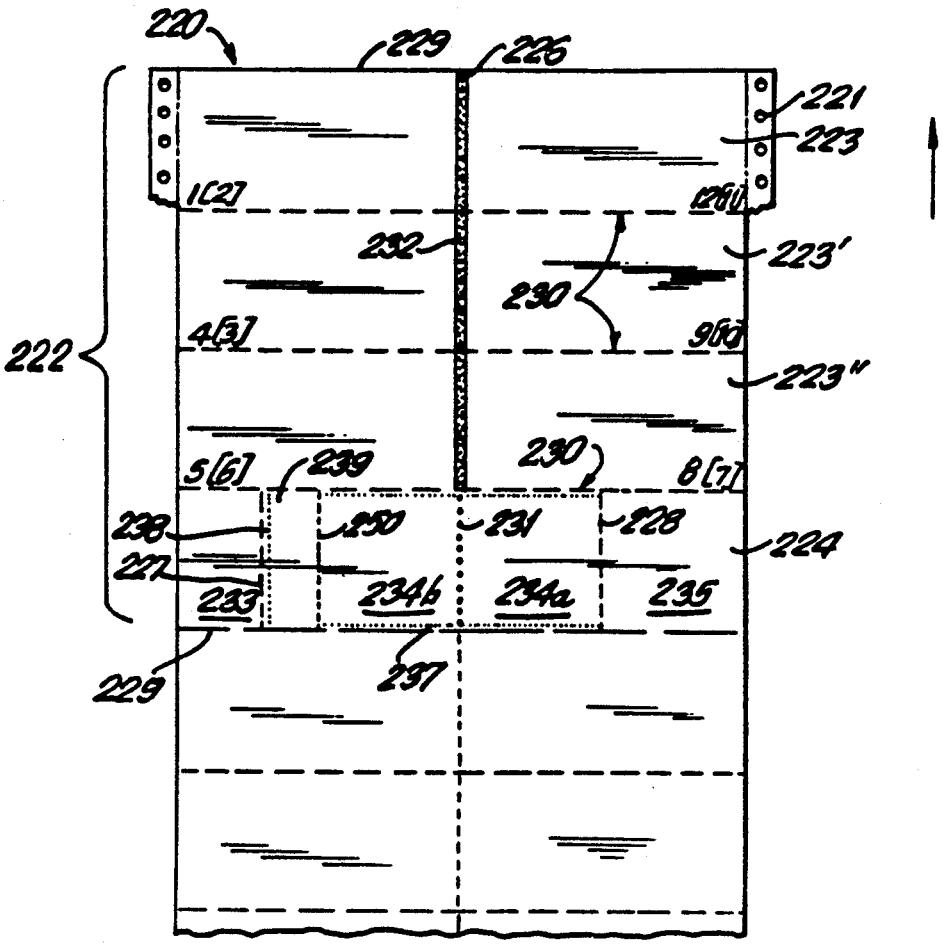
FIG. 12 is a plan view of another embodiment of the invention in which the sheet forming the business reply envelope and optional response device is positioned at the end of a pre-printed web section.
Figure 13:
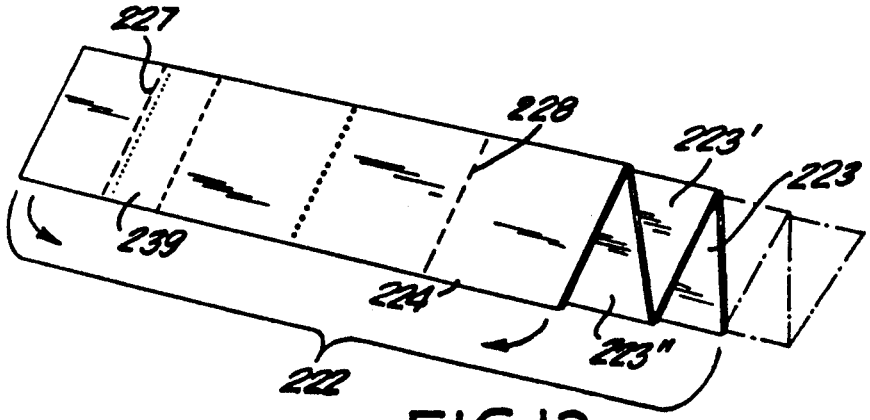
FIG. 13 is a perspective view of the web section of FIG. 12 following accordion folding.

FIGS. 12 and 13 illustrate a further embodiment for making a multi-page booklet having an integral business reply envelope and optional response device. While a twelve-page booklet is shown, the method is suitable for making booklets having a lesser or greater number of pages.

A continuous web 220 of paper is divided by transverse perforation lines 229 into repeating web sections 222. In the illustrated embodiment, each web section 222 is divided into sheets 223, 223', 223" and envelope sheet 224 by transverse page-delineating perforations 230. All of the sheets 223-223" can be form printed with text and numbered, as shown. Sheet 224, which forms the reply envelope, can also be formed printed. Any one or all of sheets 223–224 can be personalized by appropriate printing apparatus, as described above in other embodiments.

Envelope sheet 224, which is at an end of web section 222, is provided with longitudinal slit-type perforations 227 and 228 that divide the sheet into three sections 233, 234 and 235. Placement of envelope sheet 224 at the end position of the web section 222 permits the formation of a booklet having additional pages by simply adding one or more sheets to the opposite end of the web section, as shown in phantom in FIG. 13. Sheet section 224 is divided by longitudinal line 226 into front envelope panel 234*a*, rear envelope panel 234*b* and adjoining envelope flap 239. Flap 239 extends from rear panel 234*b* along fold line 250, which can be perforated to facilitate folding. Envelope panels 234*a* and 234*b*, when folded along longitudinal line 226, will form a business reply envelope. Either or both of sections 233 and 235 can form a business response device, instruction or message sheet which remains detachably connected, as by perforations, to its respective envelope panel throughout processing. Alternatively, one or both of the sheet sections 233 and 235 can be removed during bursting or die cutting.

Prior to folding, a suitable adhesive, such as a pressure sensitive adhesive, is preferably applied along the portion 232 of longitudinal line 226 extending across sheets 223-223" and along lines 237 of the front and rear envelope panels. A releasable adhesive as previously described is applied along dotted line 231. A permanent adhesive is applied along line 232 to bind the remaining sheets 223-223" comprising the remainder of the booklet and to bind the envelope panels together when they are folded to a superposed position.

FIG. 13 depicts web section 222 following bursting, die cutting and folding. An accordion-type of fold is shown, which is advantageous in this embodiment because it positions the envelope sheet 224 in an outwardly-facing position such that the envelope sheet is in the preferred, center position of the booklet after web section 222 has been folded along longitudinal line 226. However, the order and type of folding employed can be varied, and different types of folds combined, depending on the desired layout of the finished booklet, and the capabilities of the equipment. Following application of the adhesive, the web section is folded and cut in a manner similar to the embodiments described in connection with FIGS. 1–11 to produce a personalized booklet having a detachable reply envelope that is suitable for mailing. In the preferred aspect of this embodiment, at least one of sheet sections 233 and 235 of envelope sheet 224 remains detachably connected to the envelope for removal and return by the recipient in the reply envelope.

While only several specific embodiments of the booklet with integral detachable business reply envelope and optional response device have been illustrated, it will be understood that the total number and size of pages in the booklet, the order of folding steps, type of folding, and the number and configuration of business reply envelopes and response devices, are all matters of design choice to persons skilled in the art and can be varied within the scope of the appended claims.

I claim:

1. In the method of preparing a booklet having a plurality of pages from a pre-printed continuous web (20, 220) where the web (20, 220) comprises:

(a) transverse separation lines (29, 229) which divide the web (20, 220) into booklet sections (22, 222);

(b) a plurality of transverse dividing lines (30, 230) which divide each booklet section (22, 222) into a plurality of envelope and booklet sheets (23, 24, 25; 223, 223', 223", 224 each having head and foot portions; and (c) a longitudinal fold line (26, 226) extending the length of the booklet section (22, 222) and forming the backbone of the booklet and dividing each sheet into booklet pages;

where the booklet sections (22, 222) are separated from the continuous web (20, 220) along the transverse separation lines (29, 229) and folded along the dividing lines (30, 230), the improvement comprising the steps of:

(i) perforating one booklet sheet along at least one longitudinal line (27, 28; 227, 228) extending between the head and foot of the sheet to define an envelope sheet (24, 224) comprising response devices (33, 35; 233, 235) and an envelope flap (39, 239) adjacent a front envelope panel (34*b*, 234*b*) joined along the longitudinal fold line (26, 226) to a rear envelope panel (34*a*, 234*a*);

(ii) applying adhesive to at least one of the front (34*b*, 234*b*) or rear (34*a*, 234*a*) envelope panels along lines adjacent the head and foot of the panels;

(iii) applying a remoistenable adhesive along a line adjacent to the outer edge of the envelope flap (39, 239) and generally parallel to the longitudinal fold line (26, 226);

(iv) folding the envelope and booklet sheets (23, 24, 25; 223, 223', 223", 224) along the transverse sheet dividing lines (30, 230) to a superposed configuration with the envelope sheet (24, 224) facing outwardly;

(v) binding the superposed envelope and booklet sheets (23, 24, 25; 223, 223', 223", 224) together along the longitudinal fold line (26, 226);

(vi) folding the bound superposed envelope and booklet sheets (23, 24, 25; 223, 223', 223", 224) along the longitudinal fold line (26, 226) to position the front (34*b*, 234*b*) and rear (34*a*, 234*a*) envelope panels in an overlying mated configuration to form an envelope; and (vii) separating the envelope and booklet sheets (23, 24, 25; 223, 223', 223", 224) from one another at the head and foot to form a booklet containing a separate pre-formed envelope.

2. The method of claim 1 wherein the envelope is detachably bound to the longitudinal fold line (26, 226) of the booklet by a releasable adhesive.

3. The method of claim 2 which further includes the step of perforating the envelope sheet along a second longitudinal line (27, 227) adjacent the envelope flap (39, 239) to provide a response device (33, 233) detachably connected to the envelope flap (39, 239).

4. The method of claim 3 wherein at least one of the response devices (33, 35; 233, 235) is personalized.

5. The method of claim 3 wherein the response device (33, 233) is removed prior to separation of the envelope and booklet sheets (23, 24, 25; 223, 223', 223'', 224) from one another.

6. The method of claim 1, wherein the response device (35, 235) is detachably connected to the envelope rear panel (34a, 234a) along the longitudinal line (28, 228).

7. The method of claim 6 wherein the response device (35, 235) is personalized.

8. The method of claim 7 wherein at least one of the other pages comprising the booklet is personalized.

9. The method of claim 1 wherein the sheet dividing lines (30, 230) are spaced to provide a booklet having pages of equal height.

10. The method of claim 1 wherein the sheet dividing lines (30, 230) are spaced to provide a booklet having pages of different height.

11. The method of claim 1 wherein the envelope sheet (224) is positioned at one end of the booklet section (222) and the sheets (223, 223', 223'', 224) are accordion folded so that the envelope sheet (224) faces outward.

12. The method of claim 1 wherein the sheets (23, 24, 25; 223, 223', 223'', 224) are separated from one another by scissor wheel cutting.

13. The method of claim 1 wherein the sheets (23, 24, 25; 223, 223', 223'', 224) are separated from one another by guillotine cutting.

14. The method of claim 1 wherein the transverse separation lines (29, 229) are formed by slit-perforating the web.

15. The method of preparing a booklet having a plurality of pages form a pre-printed continuous web (20') where the web (20') comprises:

(a) transverse separation lines (29) which divide the web (20') into booklet impressions (43);

(b) a plurality of transverse dividing lines (30a, 30a', 30') which divide each booklet impression (43) into a plurality of envelope and booklet sheets (23', 24', 25', 44, 45, 46) each having head and foot portions;

(c) a longitudinal fold line (26') extending the length of the booklet impression (43) and forming the backbone of the booklet and dividing each sheet into booklet pages;

where the booklet impressions (43) are separated from the continuous web (20') along the transverse separation lines (29) and folded along the dividing lines (30a, 30a', 30'), one of the dividing lines (30a') dividing the booklet impression (43) into first (41) and second (22') halves, the improvement comprising the steps of:

(i) perforating one booklet sheet along at least one longitudinal line (27, 28) extending between the head and foot of the sheet to define an envelope sheet (24') comprising a response device (33, 35) and an envelope flap (39) adjacent a front envelope panel (34b) joined along the longitudinal fold line (26') to a rear envelope panel (34a);

(ii) applying adhesive to at least one of the front (34b) or rear (34a) envelope panels along lines adjacent the head and foot of the panels and along a portion (32, 40) of the longitudinal fold line (26') extending across the booklet impression half (22');

(iii) applying a remoistenable adhesive along a line adjacent to the outer edge of the envelope flap (39) and generally parallel to the longitudinal fold line (26');

(iv) folding the first (41) and second (22') booklet impression halves along the booklet impression half dividing line (30a') to a mated, superposed position and adhesively binding the first (41) and second (22') booklet impression halves together along the longitudinal fold line (26');

(v) folding the mated and bound booklet impression halves (22', 41) along the transverse sheet dividing lines (30a, 30') to a superposed configuration with the envelope sheet (24') facing outward;

(vi) binding the superposed envelope and booklet sheets (23', 24', 25', 44, 45, 46) together along the longitudinal fold line (26');

(vii) folding the bound superposed sheets (23', 24', 25', 44, 45, 46) along the longitudinal fold line (26') to position the front (34b) and rear (34a) envelope panels in an overlying mated configuration to form an envelope; and (viii) separating the envelope and booklet sheets (23', 24'25', 44, 45, 46) from one another at the head and foot to thereby form a booklet containing a separate pre-formed envelope.

16. The method of claim 15 wherein the envelope is detachably bound to the longitudinal fold line (26') of the booklet by a releasable adhesive.

17. The method of claim 16 which further includes the step of perforating the envelope sheet (24') along a second longitudinal line (27) adjacent the envelope flap (39) to provide a response device (33) detachably connected to the envelope flap (39).

18. The method of claim 17 wherein at least one of the response devices (33, 35) is personalized.

19. The method of claim 17 wherein the response device (33) is removed prior to separation of the envelope and booklet sheets (23', 24'25', 44, 45, 46) from one another.

20. The method of claim 15 wherein the response device (35) is detachably connected to the envelope rear panel (34a) along the logitudinal line (28).

21. The method of claim 20 wherein the response device (35) is personalized.

22. The method of claim 21 wherein at least one of the other pages comprising the booklet is personalized.

23. The method of claim 15 wherein the sheet dividing lines (30a, 30a', 30') are spaced to provide a booklet having pages of equal height.

24. The method of claim 15 wherein the sheet dividing lines (30a, 30a', 30') are spaced to provide a booklet having pages of different height.

25. The method of claim 15 wherein the envelope and booklet sheets (23', 24', 25', 44, 45, 46) are separated from one another by scissor wheel cutting.

26. The method of claim 15 wherein all of the sheets (23', 24', 25') to which adhesive is applied are in the same booklet impression half (22').

* * * * *